US005838327A

United States Patent [19]

Seong

[11] Patent Number: 5,838,327

[45] Date of Patent: Nov. 17, 1998

[54] CONTROLLER FOR CONVERTING DIGITAL PLANE IMAGE DATA TO VIRTUAL THREE-DIMENSIONAL IMAGE DATA

[75] Inventor: Phil Moon Seong, Seoul, Rep. of Korea

[73] Assignee: Woo Bo Electronics Co., Ltd., Seoul, Rep. of Korea

[21] Appl. No.: 742,900

[22] Filed: Nov. 1, 1996

[51] Int. Cl.[6] ..... G09G 5/00

[52] U.S. Cl. ..... 345/425; 345/427; 345/213; 382/285

[58] Field of Search ..... 345/419, 425, 345/427, 139, 213; 382/285, 294

[56] References Cited

U.S. PATENT DOCUMENTS

| | | | |
|---|---|---|---|
| 4,517,593 | 5/1985 | Keller et al. | 358/107 |
| 4,935,731 | 6/1990 | Takebe et al. | 345/213 |
| 5,202,670 | 4/1993 | Oha | 340/728 |
| 5,294,987 | 3/1994 | Saeger et al. | 348/536 |
| 5,339,111 | 8/1994 | Park | 348/524 |
| 5,625,505 | 4/1997 | Ohmori et al. | 360/46 |
| 5,654,777 | 8/1997 | Shin | 345/213 |

*Primary Examiner*—Richard A. Hjerpe
*Assistant Examiner*—Ricardo Osorio
*Attorney, Agent, or Firm*—Spencer & Frank

[57] ABSTRACT

The present invention relates to a controller for converting digital plane image data to virtual three-dimensional image data, comprising a frequency counting unit for counting frequency after receiving a horizontal synchronous frequency signal and an image frequency clock signal; and an image control signal generating unit for outputting a signal to control image digital data having a fixed bit number by receiving an output of the frequency counting unit and a horizontal synchronous frequency signal applied from the external. Thus the present invention can convert ordinary 2-dimensional image data to virtual 3-dimensinal image data by the real-time process with the help of a simple circuit.

3 Claims, 4 Drawing Sheets

CONTROLLER FOR CONVERTING DIGITAL PLANE IMAGE DATA TO VIRTUAL THREE-DIMENSIONAL IMAGE DATA

BACKGROUND OF THE INVENTION

1. Field of the invention

The present invention relates to a controller for controlling the conversion of digital image data, and more particularly to a controller for converting digital plane image data to virtual three-dimensional image data.

2. Description of Prior Art

Generally, the fundamental principle of realizing a three-dimensional image is to arouse cubic effect by making use of an optical illusion.

Previously, according to the above principle, a virtual three-dimensional image has been realized by synthesizing two pieces of image, which were photographed in the left and right optic angle, respectively, and then generating a picture image.

However, the prior art in accordance with the above principle requires that lots of an additional image data, which were photographed in the left and right optic angle, be properly processed in order to generate a 3-dimensional picture image.

Therefore, it is impossible to perform a real-time process and difficult to directly apply the prior art to the existing 2-dimensional image media.

SUMMARY OF THE INVENTION

Accordingly, the present invention is devised to disentangle the above-mentioned problems, and its object is to provide a controller for converting digital plane image data to a virtual three-dimensional image, wherin the virtual three-dimensional image data can be made by adopting the method of receiving a horizontal synchronous frequency signal and an image frequency clock signal in order to control any applied 2-dimensional plane image data such that a certain pixel data can be either added to or omitted from the applied 2 -dimensional plane image data before the applied signal is outputted.

Thus, without any additional image data photographed in the left and right optic angle, the ordinary 2-dimensional digital image data can be converted to virtual 3-dimensional image data by real-time process.

In accordance with the present invention, in a controller for converting digital plane image data to virtual 3-dimensional image data, the controller comprises:

- a frequency counting means for counting frequency after receiving a horizontal synchronous frequency signal and an image frequency clock signal; and
- an image control signal generating means for outputting a signal to control image digital data having a fixed bit number by receiving an output of said frequency counting means and a horizontal synchronous frequency signal applied from the external.

DETAILED DESCRIPTION OF THE PREFERRED EMBODIMENT

Referring to the accompanying drawings, the preferred embodiment of the present invention will now be described in detail.

Figure 1:
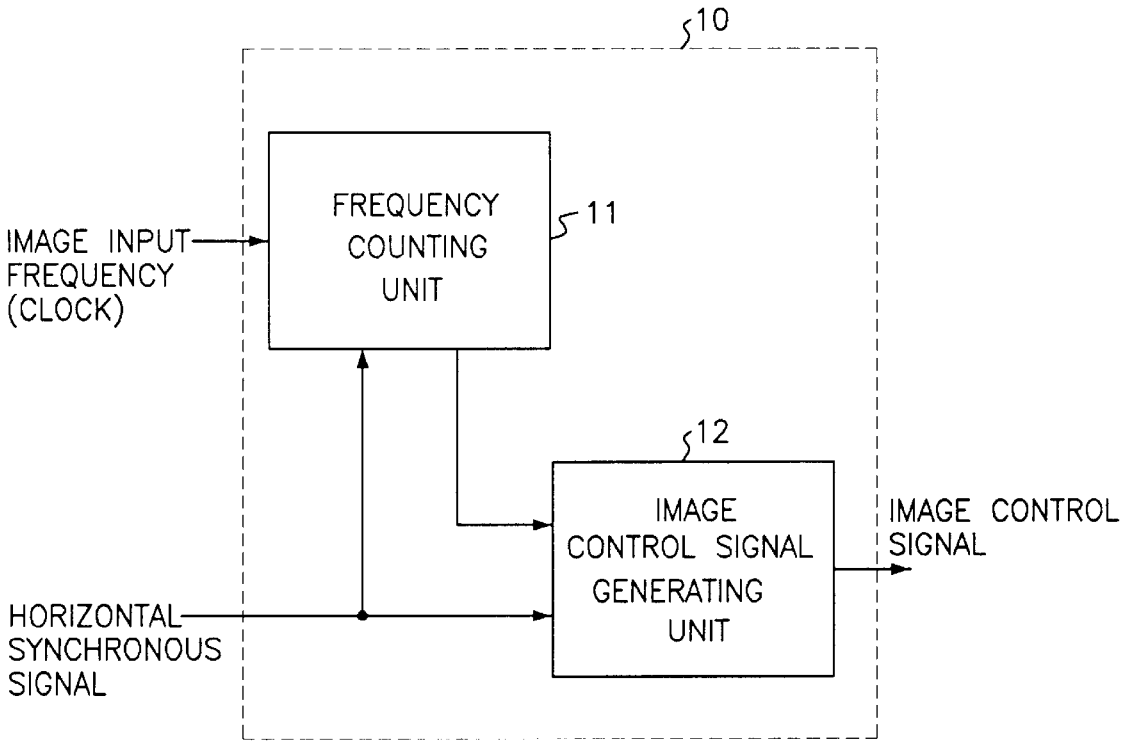
FIG. 1 is a block diagram showing a controller for converting digital plane image data to virtual three-dimensional image data in accordance with the present invention.

FIG. 1 is a block diagram showing a controller for converting digital plane image data to virtual three-dimensional image data in accordance with the present invention, wherein 11 represents a frequency counting unit, and 12 represents an image control signal generating unit, respectively.

As shown in FIG. 1, a controller 10 for converting digital plane image data to virtual three-dimensional image data in accordance with the present invention consists of:

- a frequency counting unit 11, which is known in the prior art, for counting frequency after receiving a horizontal synchronous frequency signal, which is one of the elements composing an image signal, and an image frequency clock which is used to control the transmission rate of image digital data; and
- an image control signal generating unit 12 for outputting a signal to control digital data of 8 bits by receiving an output of said frequency counting unit 11 and a horizontal synchronous frequency signal applied from the external image output equipment.

The frequency counting unit 11, which is composed of an ordinary up-down counter(in the present embodiment, 9 bits counter is used), sequentially counts an image input frequency signal(clock) in line with a horizontal synchronous frequency signal, and divides an applied ordinary 2-dimensional digital image data into the left and right pixel, whose boundary is defined by the central line of the image (hereinafter, referred to as a base line), so that it is possible to repeatedly add or omit any pixel data.

The image control signal generating unit 12, which is composed of an ordinary up-down counter(in the present embodiment, 3 bits counter is used) and an inverting circuit unit for inverting a signal, counts an output signal of the up-down counter of said frequency counting unit 11 in line with a horizontal synchronous frequency signal in order to generate a control signal for adding or omitting any pixel data.

Actually, said control signal is generated in the following manner:

- the control signal is sequentially increasing before said base line, meanwhile the control signal is sequentially decreasing.

As described above, a three-dimensional image can be obtained by adding or omitting a fixed pixel of an applied plane image data having a base line. Each right and left image data seems to be photographed in a right and left optical angle.

In addition, the above data conversion can be applied to either an image mixed by the three primary colors such as red, blue, and green or an image having only one of the primary colors.

Alternatively, the ratio of addition to omission of the image data can be regulated at one's discretion.

Figure 2:
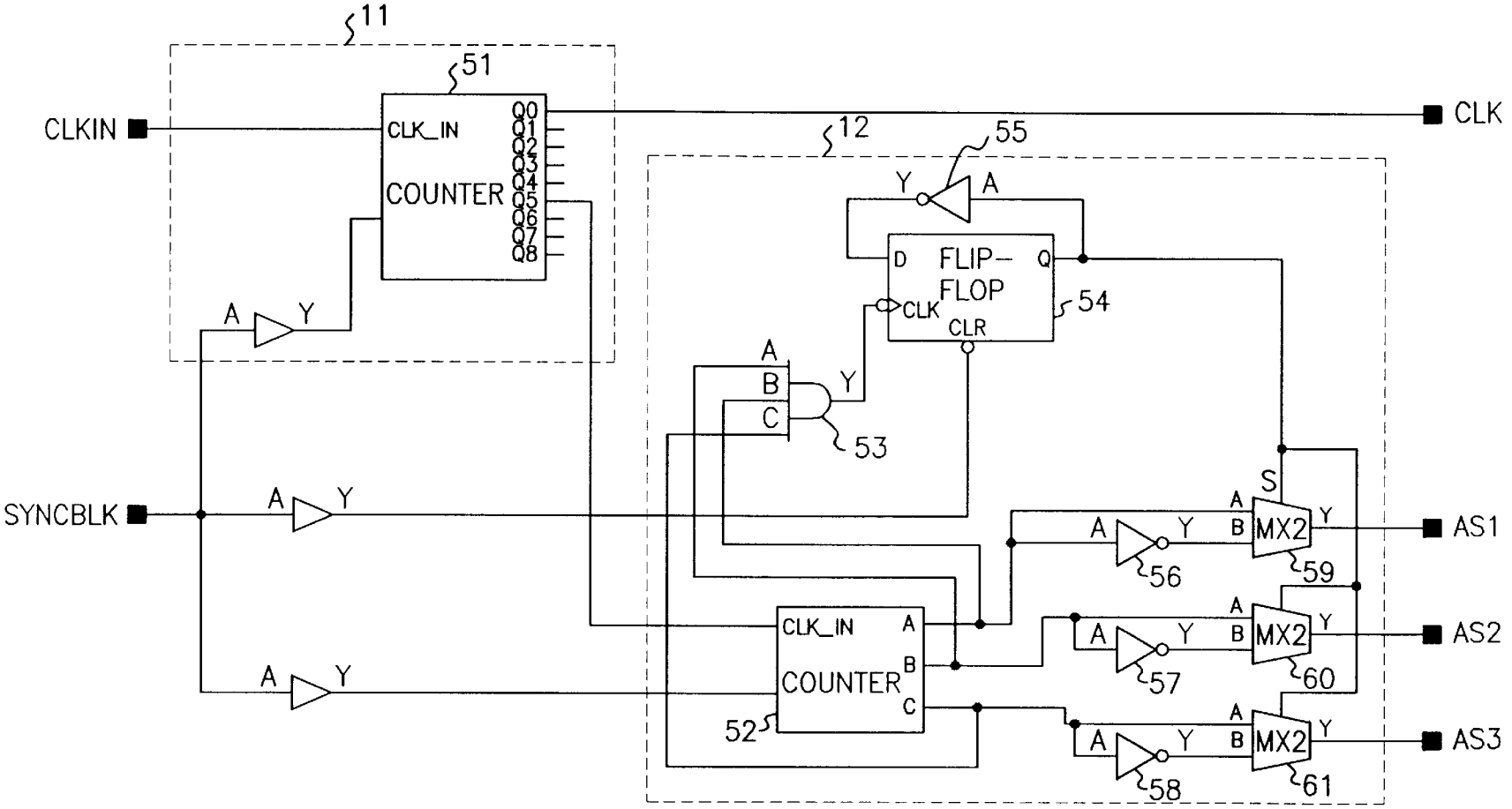
FIG. 2 is a circuit diagram showing one embodiment of FIG. 1.

FIG. 2 is a circuit diagram showing one embodiment of FIG. 1. Said frequency counting unit 11 is composed of a counter 51 which is known in the prior art. Said counter 51, of which the reset signal is a horizontal synchronous signal SYNCBLK, performs a sequential counting in line with a clock CLKIN.

In accordance with the present embodiment, said counter 51 uses a 9-bit counter which can count from a decimal 0 to a decimal 511.

Of the all output pulses, or Q1 to Q8, the sixth output pulse Q5 which can generate 8 clocks is used as a clock signal of said image control signal generating unit 12.

For reference, in case the image data has 16 bits, the fifth output pulse Q4, which can generate 16 clocks, is used as a clock signal of said image control signal generating unit 12.

Obviously, the more bits the image data has, the better the quality of the virtual 3-dimensional image.

As shown in FIG. 2, said image control signal generating unit 12 is composed of a counter 52, an OR gate 53, T flip-flop 54 and 55, inverters 56 to 58, multiplexers 59 to 61, wherein said counter 52 receives the sixth output pulse Q5 of said counter 51 as a clock signal. Said counter 52 sequentially counts from "0" to "7" in line with said horizontal synchronous signal SYNCBLK, and then outputs the results by weight.

Said OR gate 53 logically adds the outputs(A, B, and C) of said counter 52. Said T flip-flop 54 and 55 receives the output of said OR gate 53 as a clock signal, and receives said horizontal synchronous signal SYNCBLK as a clear signal.

Therefore, said T flip-flop 54 and 55 toggles its output Q when it becomes cleared after said counter 52 ouputs binary digits "111", or a decimal digit "7".

Said inverters 56 to 58 and multiplexers 59 to 61, which are connected to said counter 52, are configured to generate image control signals AS1, AS2 and AS3 by either transmitting the output of said counter 52 as it is, or inverting the output of said counter 52 under the control of the output Q of said T flip-flop 54 and 55.

Figure 3:
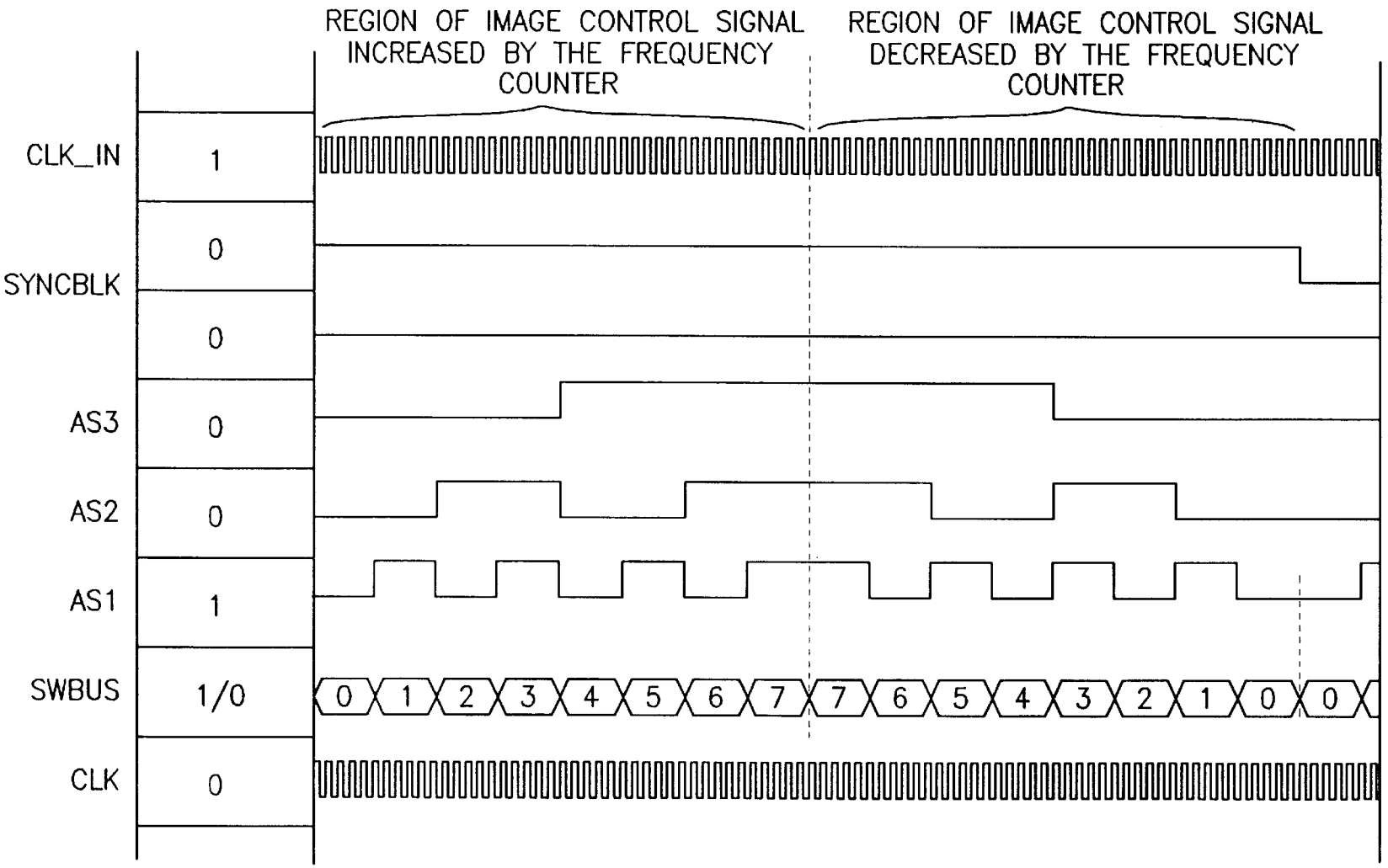
FIG. 3 is a waveform diagram of the internal signal of FIG. 2.

For reference, the waveform of the signal in FIG. 2 is shown in FIG. 3.

Figure 4:
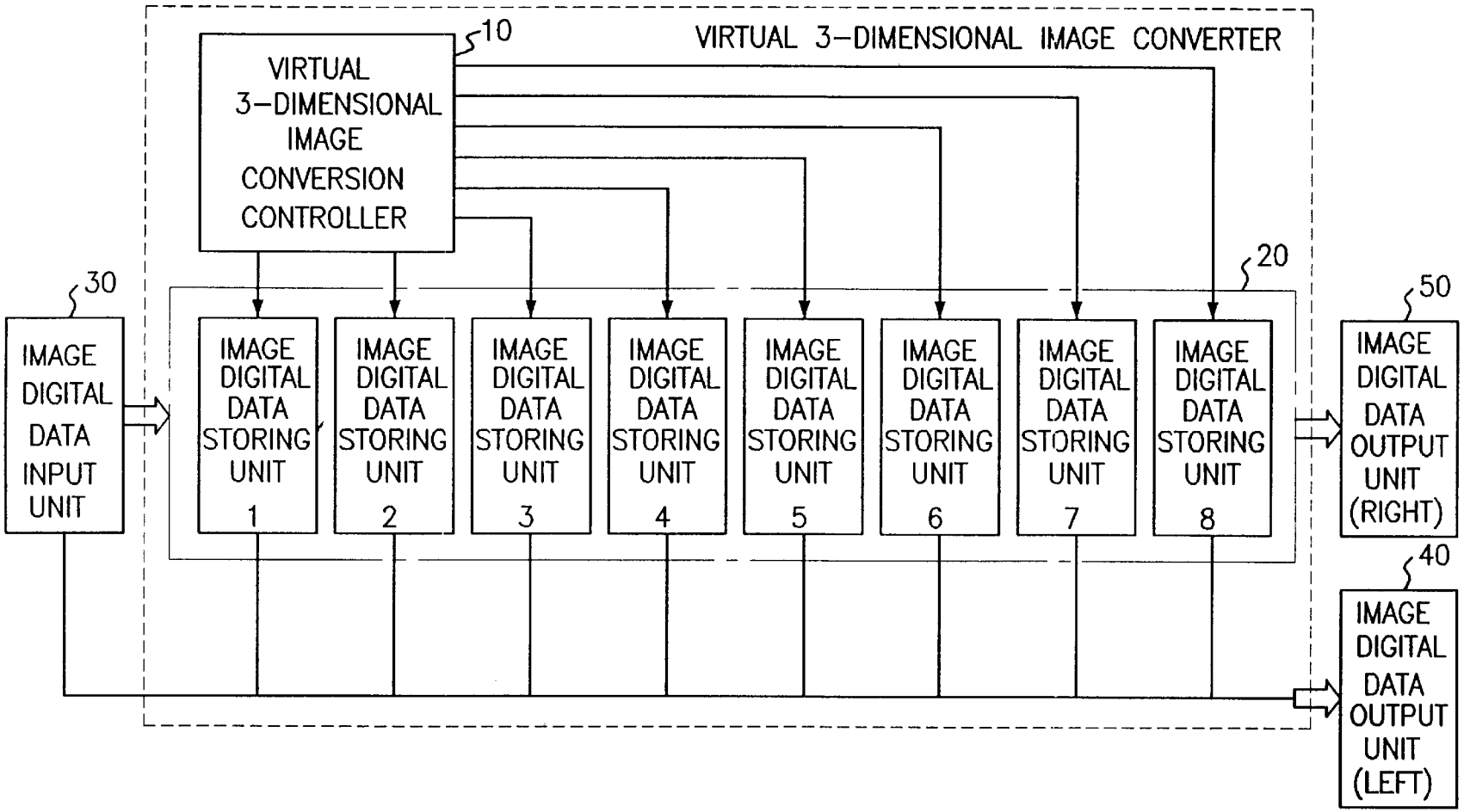
FIG. 4 is a diagram illustrating one embodiment using a controller in accordance with the present invention.

Meanwhile, an embodiment of a virtual 3-dimensional image converter adopting a controller for converting digital plane image data to virtual 3-dimensional image data in accordance with the present invention is shown in FIG. 4, wherein 10 denotes a controller for converting digital plane image data to virtual 3-dimensional image data, and 20 denotes an image digital data storing unit.

Said controller 10 generates a control signal to add or omit data that are applied from said image digital data input unit 30 to said digital data storing unit 20 after receiving a horizontal synchronous frequency signal which is one of the elements composing an image signal and an image frequency clock signal which can control the transmission rate of image digital data.

In the meantime, said image digital data storing unit 20 stores, adds or omits data applied from said image digital data input unit 30 under the control of said controller 10.

Then, applied plane image data can be converted to virtual 3-dimensional image data by sequentially transmitting the stored, omitted, or added data to said image digital data output units 40 and 50.

As described above, the present invention can convert ordinary 2-dimensional image data to virtual 3-dimensinal image data by the real-time process with the help of a simple circuit.

The present invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A controller for converting digital plane image data to virtual 3-dimensional image data, said controller comprising:

a frequency counting means for counting frequency after receiving a horizontal synchronous frequency signal and an image frequency clock signal; and an image control signal generating means for outputting a signal to control image digital data having a fixed bit number by receiving an output from said frequency counting means and said horizontal synchronous frequency signal;

wherein said image control signal generating means comprises:

a second counter for sequentially counting in line with said horizontal synchronous signal, and then outputting the result by weight, after receiving an output pulse from said frequency counting means as a clock signal;

a toggling means, which receives said horizontal synchronous signal as a clear signal, for toggling its output under the control of said second counter; and a plurality of multiplexers, which are connected to said second counter, for generating a plurality of image control signals by either transmitting the output of said second counter as it is or inverting the output of said second counter under the control of the output of said toggling means.

2. A controller for converting digital plane image data to virtual 3-dimensional image data as claimed in claim 1, wherein said frequency counting means comprises a first counter of a fixed bit number, receiving said horizontal synchronous signal as a reset signal, for counting in line with said image frequency clock signal and applying one of its output pulse signals to said image control signal generating means as said clock signal.

3. A controller for converting digital plane image data to virtual 3-dimensional image data as claimed in claim 1, wherein said toggling means comprises:

an OR gate for logically adding the outputs of said second counter; and a T flip-flop which receives the output of said OR gate as a clock signal, and receives said horizontal synchronous signal as a clear signal.

* * * * *